United States Patent [19]

Satomi

[11] 4,140,386

[45] Feb. 20, 1979

[54] ELECTROPHOTOGRAPHIC APPARATUS

[75] Inventor: Toyokazu Satomi, Tokyo, Japan

[73] Assignee: Ricoh Company, Ltd., Tokyo, Japan

[21] Appl. No.: 832,843

[22] Filed: Sep. 13, 1977

[30] Foreign Application Priority Data

Sep. 14, 1976 [JP] Japan ..... 51-110192
Sep. 20, 1976 [JP] Japan ..... 51-112604

[51] Int. Cl.[2] ..... G03G 15/00
[52] U.S. Cl. ..... 355/14; 355/8
[58] Field of Search ..... 355/14, 3 R, 8, 3 BE

[56] References Cited

U.S. PATENT DOCUMENTS 3,736,055 5/1973 Davidge et al. ..... 355/14

*Primary Examiner*—Richard L. Moses
*Attorney, Agent, or Firm*—Frank J. Jordan

[57] ABSTRACT

For producing a plurality of copies of an original document which has a length less than one-half a maximum document length which can be accomodated by the apparatus, a plurality of electrostatic images are formed on a rotating photoconductive drum by alternately forming an image on one image space and letting one or more image spaces pass before forming the next image. Development and transfer of the electrostatic images are effected during a last imaging revolution of the drum and may be further effected during subsequent revolutions of the drum for repeated development and transfer using the same electrostatic images. The number of electrostatic images formed on the drum is computed as a function of the length of the original document and the number of copies to be made to minimize the number of revolutions of the drum required to produce the copies and thereby maximize the copying speed. The number of electrostatic images formed is not necessarily the maximum number which can be formed on the drum.

8 Claims, 6 Drawing Figures

ELECTROPHOTOGRAPHIC APPARATUS

BACKGROUND OF THE INVENTION

The present invention relates specifically to a substantial improvement to the disclosure of U.S. Patent application No. 661,579, filed Feb. 26, 1976 by the same applicant as the present application and relates generally to a method and apparatus for forming a plurality of identical images at equal spacing on the circumference of a photoconductive member such as a drum or endless belt.

In known electrophotographic or electrostatographic copying apparatus, a photoconductive drum is imaged, and the image is developed and transferred during one rotation of the drum. Even if the length of an original document for reproduction is less then ½ the circumference of the drum, only one copy will be produced for each rotation of the drum. It is also known in the art to form an electrostatic image on a photoconductive drum, and then develop and transfer the image a plurality of times to copy sheets. In the present state of the art, an electrostatic image may typically be developed and transferred up to 30 times. Even if this process is applied to multiple copy applications, only one copy may be produced for each rotation of the drum regardless of the size of the image.

It is also known in the art in applications in which two or more images of a small original document can be spaced on the circumference of a drum to rotate the drum during one scanning operation to form a first image, stop the drum rotation while the scanning system resets, and again rotate the drum for another scanning operation. Whereas this method increases the copying efficiency by producing more than one copy for each rotation of the drum after all of the images have been formed on the drum using the multiple development and transfer method described above, the mechanism for precisely starting and stopping the drum in dependence on the number of images to be produced is necessarily complex and costly.

In another known method of producing a plurality of images on the drum surface, the drum is rotated continuously and the scanning mechanism is reset at high speed between scanning operations, the speed of various members of the scanning mechanism exceeding 1000mm/sec. during such an operation. The power required for driving a scanning mechanism at this speed is excessive, and the high rates of acceleration and deceleration cause scanning lamps and precision optical components to fail rapidly.

Applicant's prior U.S. Patent application discloses a method of overcoming these problems by forming a plurality of images of the same original document at equal spacing on the circumference of a photoconductive drum or the like. The images are developed a number of times, and the resulting toner images are transferred to copy sheets after each developing step. The method comprises forming an image on one section of the drum and then rotating the drum by a plurality of image spaces before forming an image on another section. The number of image spaces skipped is determined by the number of images to be formed in such a manner that the images will be formed only once during a predetermined number of rotations of the drum.

This method is especially advantageous where large number of copies are to be made and is capable of increasing the copying speed to more than double the speed of normal copying.

However, this prior method is not advantageous where the number of copies to be made is between about 3 and 10. This is because the prior method forms the maximum number of electrostatic images on the drum before development and transfer, and where a small number of copies is required not all of the images are necessary. In addition, the relatively large number of drum revolutions required for image formation decreases the copying speed for making a small number of copies.

SUMMARY OF THE INVENTION

The present invention overcomes the latter described problem by computing the number of electrostatic images to be formed as a function of the length of the original document and the number of copies to be produced in such a manner as to minimize the total number of revolutions required to produce the copies. In accordance with this principle, the number of electrostatic images formed is not necessarily the maximum number that can be formed. This eliminates unnecessary imaging revolutions of the drum where a small number of copies such as between 3 and 10 are to be produced.

It is an object of the present invention to overcome all drawbacks described hereinabove relating to prior art electrophotographic apparatus.

It is another object of the present invention to maximize copying speed where a small number of copies is to be produced.

It is another object of the present invention to provide a generally improved electrophotographic apparatus.

Other objects, together with the foregoing, are attained in the embodiment described in the following description and illustrated in the accompanying drawing.

DESCRIPTION OF THE PREFERRED EMBODIMENT

While the electrophotographic apparatus of the invention is susceptible of numerous physical embodiments, depending upon the environment and requirements of use, substantial numbers of the herein shown and described embodiment have been made, tested and used, and all have performed in an eminently satisfactory manner.

Figure 1:
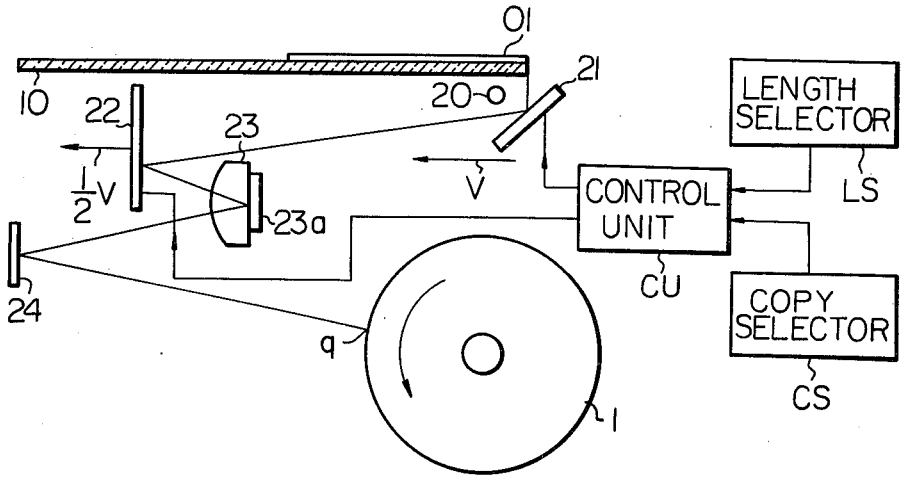
FIG. 1 is a schematic view of an image forming apparatus embodying the present invention.

Referring now to FIG. 1, a transparent document holder or platen 10 is arranged to fixedly retain an original document 01. An imaging system comprises a light source 20 which is arranged to move leftward (as viewed in FIG. 1) in a scan direction integrally with a plane mirror 21 at a velocity V. A return direction is rightward. The mirror 21 reflects an image of the document 01 onto a plane mirror 22 which moves leftward at a velocity ½V. From the mirror 22, the image is reflected and converged by a fixed plano-convex lens or half lens 23 having a rear silvered plane reflecting surface 23*a*. From the lens 23, the image is reflected by a fixed mirror 24 onto the surface of a continuously rotatably moving photoconductive drum 1 at a point q. The drum 1 has an endless circumference L, and the velocity V is selected to be equal to the surface speed of the drum 1, thereby effecting a scanning operation of the document 01.

The present invention may similarly be practiced by fixing the mirrors 21 and 22 in place and moving the platen 10. It is also possible to move the platen 10 rightward as the mirrors 21 and 22 move leftward.

A length selector LS is provided so that the apparatus operator may input the length of the original document 01 to the apparatus. Although not shown in detail, the length selector LS may comprise a pointer slidable from the rightmost edge of the platen 10 to the left edge of the document 01, the pointer being connected to a potentiometer (not shown) by a cable and pulley mechanism. The output of the length selector LS is connected to an input of a control unit CU which controls the movement of the mirrors 21 and 22 and the energization of the light source 20.

Figures 2A, 2B, 2C, 2D:
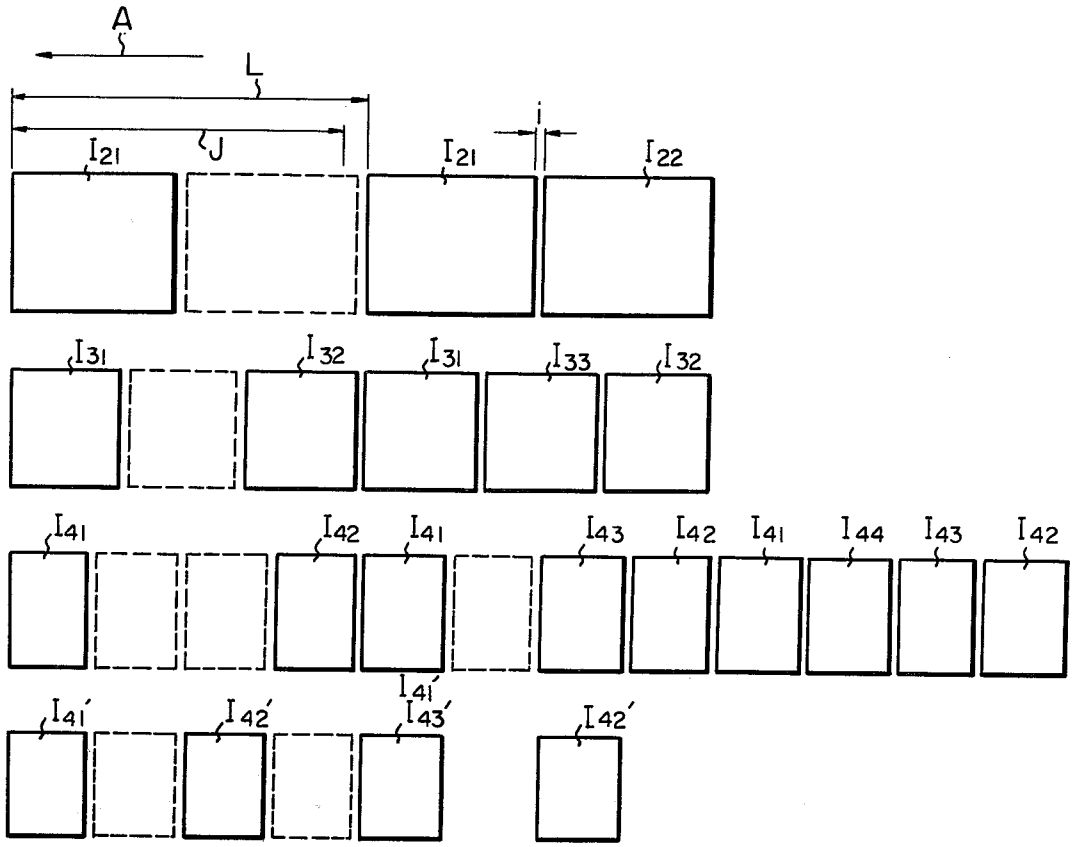
FIG. 2*a* is a diagram illustrating a method of forming two images on the surface of a photoconductive drum in accordance with the present invention.
FIG. 2*b* is similar to FIG. 2*a* but illustrates forming 3 images.
FIG. 2*c* is similar to FIG. 2*a* but illustrates forming 4 images.
FIG. 2*d* is a graphic illustration of an inoperative method of forming 4 images on the surface of a photoconductive drum.

The present invention is applicable in cases in which two or more images of the original document 01 may be formed on the circumference of the drum 1. Referring to FIG. 2*a*, the circumferential length of the drum 1 surface is designated as L and the length of a maximum sized original document is designated as J. A margin is therefore provided having a length L-J. It will be understood that the actual length of the largest original document 01 may be larger or smaller than J in applications involving reduced or enlarged scale copying. The length J is that of the image of the maximum sized original document 01 projected on the drum 1 surface by the imaging system. In scanning, the control unit CU controls the mirror 21 to move rightward from its rightmost of initial position by a distance equal to the actual length of the original document 01 and then return to the initial position at the same velocity V. The mirror 22 similarly moves by a distance equal to ½ the length of the original document 01.

The imaging method of applicant's prior patent application is graphically illustrated in FIG. 2*a* for forming two images of an original document of length J/2 in two spaces on the drum 1 surface each having a length L/2. The length of margins i between the images is equal to ½ the available margin length of L-J or (L-J)/2. It will be assumed that the images are formed on the drum 1 surface in the direction of an arrow A.

The control unit CU energizes the light source 20 and moves the mirrors 21 and 22 as the drum 1 surface moves past the point q by a distance L/2 to form a first image of the original document 01 designated as $I_{21}$. The control unit CU then de-energizes the light source 20 and returns the mirrors 21 and 22 to their rightmost positions as the drum 1 surface moves past the point q by two distances L/2, thereby skipping two image spaces. The control unit CU then again energizes the light source 20 and mirrors 21 and 22 to produce another image $I_{22}$ as the drum 1 surface moves past the point q by a length L/2. It will be seen that during two rotations or movements of the drum 1 surface past the point q, two identical images of the original document 01 are formed in an equally circumferentially spaced manner on the surface of the drum 1. These images are then developed and transferred as will be described below a number of times to produce multiple copies of the document 01.

Before proceeding to the general principles of the present invention, the exemplary cases of forming three and four identical images of original documents having image lengths of J/3 and J/4 respectively will be presented with reference to FIGS. 2*b* and 2*d*.

Referring to FIG. 2*b*, a first image $I_{31}$ is formed on the drum 1. One image space is skipped and another image $I_{32}$ is formed. One more image space is then skipped and a third image $I_{33}$ is formed between the images $I_{31}$ and $I_{32}$. It will be seen that three identical images are formed in two rotations of the drum 1 without overlapping, or forming an image twice on the same portion of the drum 1.

In FIG. 2*c*, a first image $I_{41}$ is formed and two image spaces are skipped. Second, third and fourth images $I_{42}$, $I_{43}$ and $I_{44}$ are then formed in three rotations of the drum 1 by alternatingly forming an image and skipping two image spaces. As in the previous cases, an image is formed on a given portion or section of the drum 1 surface only once.

FIG. 2*d* illustrates an inoperative method of attempting to form four images on the drum 1. In this case, only one space is skipped after forming an image rather than two spaces as in the operative method shown in FIG. 2*c*. Whereas first and second images $I_{41'}$ and $I_{42'}$ are formed satisfactorily, a third image $I_{43'}$ is formed on the same section as the first image $I_{41'}$. This inoperative example illustrates that the number of image spaces to be skipped after forming an image must be properly selected in dependence on the number of images to be formed.

The control unit CU may comprise electronic comparators, cams, or any other known computing means for determining the number N of images to be formed as a function of the length S of the original document 01. The number N is selected to fulfill the condition $(L/N+1)) < S \leqq (L/N)$ where no margin length L-J is provided and to fulfill the condition $(J/(N+1)) < S \leqq (J/N)$ where a margin length L-J is provided. The margin spaces between adjacent images have the length (L/N)-S.

Where K is the number of image spaces to be skipped after forming one image and before forming another image and M is the total number of rotations of the drum 1 for image formation, for all odd values of N, K=1 and M=2. For even values of N greater than 2, the relation L=N-2 generally holds. However, there are usually values of L less than N-2 which provide operative results. The lowest operative value of L is of course the value selected, and for both odd and even lowest operative values of N, M=L+1. Table 1 below lists the lowest operative values of K and M for values of N between 2 and 10. The values for N greater than 10 can be determined if required by those skilled in the art.

Also shown in Table 1 is a parameter P, which represents the number of copies at which it is advantageous to utilize applicant's prior method rather than the conventional method of producing one copy for each rotation of the drum 1. Specifically, for each value of N, Table 1

| N | K | M | P |
|---|---|---|---|
| 2 | 2 | 2 | 6 |
| 3 | 1 | 2 | 5 |
| 4 | 2 | 3 | 6 |
| 5 | 1 | 2 | 4 |
| 6 | 4 | 5 | 8 |
| 7 | 1 | 2 | 4 |
| 8 | 2 | 3 | 5 |
| 9 | 2 | 2 | 4 |
| 10 | 2 | 3 | 5 |

the corresponding value of P represents the number of copies which this method will produce in one less rotation of the drum 1 than the conventional method. As will be described in detail with reference to FIG. 3, the control unit CU preferably comprises means to cause the electrophotographic apparatus to perform the conventional copying method when the desired number of copies for the given value of N is less than P, and to perform applicant's prior method when the desired number of copies is equal to or greater than P. The apparatus comprises a copy selector CS by which the apparatus operator inputs the desired number of copies into the control unit CU. The control unit CU computes the value of N from the length S of the original document 01, and then computes the value of P according to Table 1. The latter function may be performed in a highly advantageous manner by an integrated circuit read-only memory(ROM), which is not shown. The value of P is then compared with the desired number of copies set into the copy selector CS by the control unit CU in order to cause the apparatus to perform the desired imaging operation.

The number of copies which can be produced during R rotations of the drum 1 is (R-M)N, where R is greater than M. Table 2 below shows the number T of copies which can be produced during 10 rotations of the drum 1 for values of N from 2 to 10. As discussed above, an electrostatic image can be developed and transferred up to 30 times in the present state of the art.

Table 2

| N | T |
|---|---|
| 2 | 16 |
| 3 | 24 |
| 4 | 28 |
| 5 | 40 |
| 6 | 30 |
| 7 | 56 |
| 8 | 56 |
| 9 | 72 |
| 10 | 70 |

In each case, the conventional method will produce only 10 copies in 10 rotations of the drum 1 regardless of the size of the original document 01. The method of the present invention will produce as many as 72 copies in 10 rotations of the drum 1. The advantage of applicant's prior method will become vividly clear from an examination of Table 2 for applications in which it is desired to make a large number of copies of a small original document 01.

However, there has existed heretofore a gap between the conventional copying method and applicant's prior method where a number of copies between about 3 and 10 is to be made regarding copying speed and efficiency. For example, where N=4, applicant's prior method is disadvantageous unless it is desired to make at least 6 copies. Where it desired to make 5 copies, the conventional method requires the same number of revolutions of the drum 1 as applicant's prior method, or 5 revolutions. As will be seen from the following description, the present invention closes this gap and allows 5 copies to be made in only 3 revolutions of the drum 1, constituting a speed increase of almost 67%.

Figure 3:
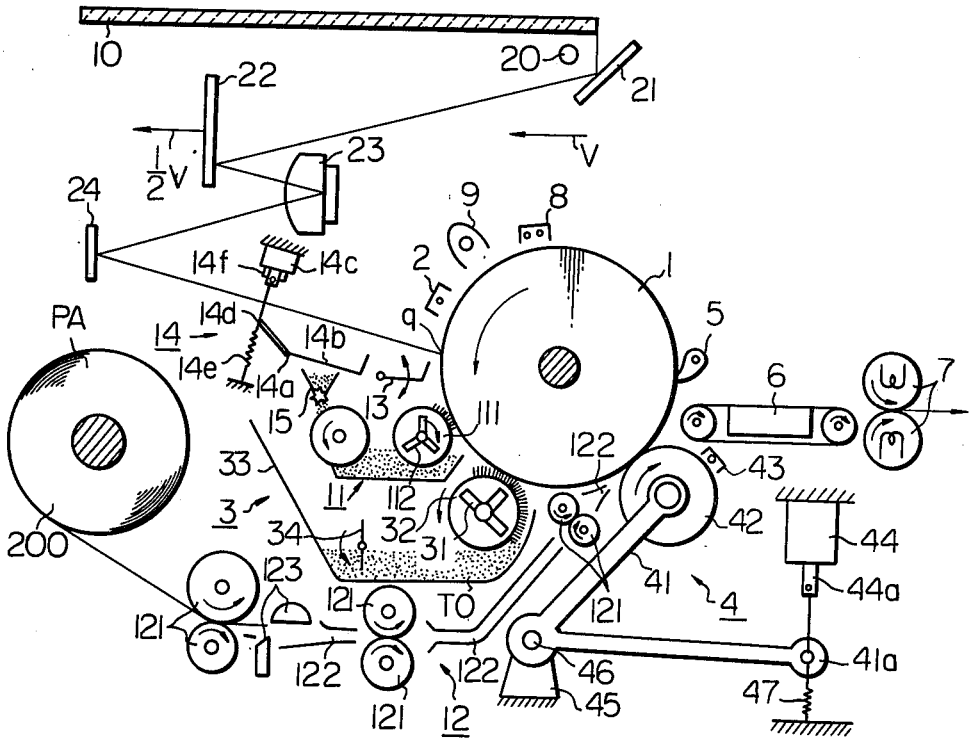
FIG. 3 is a schematic view of the image forming apparatus of FIG. 1 incorporated in an electrophotographic copying machine.

FIG. 3 shows an electrophotographic apparatus which is adapted to embody the conventional copying method, applicant's prior copying method and applicant's present copying method as will be understood from the following description.

The drum 1 is rotatable counterclockwise as shown by an arrow relative to a charging unit 2 which applies a uniform electrostatic charge to the surface of the drum 1. Arranged downstream of the charging unit 2 is a developing unit 3 and a transfer unit 4. A separator pawl 5 and discharge conveyor 6 are provided downstream of the transfer unit 4 followed by thermal fixing rollers 7. A discharge unit 8 and discharge lamp 9 are operative to remove any residual charge from the surface of the drum 1. A cleaning unit 11 for removing any residual developer from the drum 1 surface is located upstream of the developing unit 3. A sheet feed unit 12 is arranged to feed copy paper PA from a roll 200 into contact with the surface of the drum 1 downstream of the developing unit 3. A light valve plate 13 is swingable to adjust the intensity of the image formed on the drum 1. A shutter unit 14 is also provided which will be described in detail below. The apparatus is operative to perform a conventional copying process in which one copy is produced for each rotation of the drum 1 and copying processes embodying applicant's prior and present inventions in which a plurality of copies are produced from one rotation of the drum 1.

The conventional method will first be described in conjunction with the detailed construction of the various units of the apparatus.

The document 01 is placed on the platen 10 with one edge aligned with the rightmost edge thereof. The apparatus operator sets the length S of the original document 01 into the control unit CU along with the required number of copies. If the required number of copies is less than P, the control unit CU will cause the apparatus to execute the conventional copying method.

The surface of the drum 1 is charged by the charging unit 2. As the leading edge of the charged portion of the drum 1 reaches the imaging position q, the control unit CU energizes the light source 20 and the mirrors 21 and 22 to move leftward in the scan direction. A light sensor (not shown) properly adjusts the light valve plate 13 to provide the correct luminous intensity on the surface of the drum 1. The light image causes the drum 1 to locally conduct and dissipate the charge induced thereon to form an electrostatic image.

During this operation, the cleaning unit 11 is rendered inoperative. The developing unit 3 comprises a developing tank 33 which contains powdered developer TO made up of a mixture of toner and carrier particles. A non-magnetic sleeve 32 rotates counterclockwise in the developing tank 33 and has magnets 31 therein which attract the developer TO to the surface of the sleeve 32 to form a magnetic brush. The developer TO particles comprising the magnetic brush are brushed in contact with the drum 1 so that the particles are electrostatically attracted to areas of the drum 1 which retain an electrostatic charge to produce a visual toner image. An agitator 34 is provided in the tank 33 to homogenize the developer TO.

Feed rollers 121 feed the copy paper PA from the roll 200 through a cutter 123 and guide 122. The cutter 123 is controlled by the control unit CU to cut the copy paper PA to the length S. Other feed rollers which are also designated as 121 feed the cut copy paper PA into contact with the drum 1 in alignment with the leading edge of the electrostatic image.

The transfer unit 4 comprises a bellcrank lever 41 which is pivotal about a pin 46 provided to a fixed member 45. An upper end of the lever 41 rotatably carries a transfer roller 42 having a surface coated with an insulating plastic material. A charger 43 is arranged adjacent to the surface of the roller 42 to apply a charge thereto which has a polarity opposite to that of the charging unit 2. A lower end 41*a* of the lever 41 is urged downward by a tension spring 47 so that the lever 41 is urged clockwise and the roller 42 is urged away from the surface of the drum 1. A solenoid 44 has a plunger 44*a* which is also connected to the end 41*a* of the lever 41. When the solenoid 44 is de-energized, the roller 42 is maintained out of engagement with the drum 1 by the spring 47. As the copy paper PA engages with the drum 1, the solenoid 44 is energized by the control unit CU so that the lever 41 is rotated counterclockwise and the roller 42 is urged to press the copy paper PA against the surface of the drum 1. The pressure and charge of the roller 42 causes the toner image to be transferred to the copy paper PA. The copy paper PA is separated from the drum 1 by the separator pawl 5, and conveyed by the discharge conveyor 6 through the thermal fixing rollers 7 which fix the toner image onto the copy paper PA and out of the apparatus.

The cleaning unit 11 comprises a rotary sleeve 111 containing magnets 112. After the surface of the drum 1 is discharged by the discharging unit 8 and discharging lamp 9, the sleeve 111 acts as a magnetic brush to remove residual developer TO from the drum 1. A toner replenishment unit 15 is also shown. The light source 20 is de-energized and the mirrors 21 and 22 are returned to their rightmost positions in preparation for another copying operation. The solenoid 44 is de-energized to de-actuate the transfer unit 4.

When the required number of copies in equal to or greater than P, the control unit CU executes the method of applicant's prior invention. The charging unit 2 is energized for one rotation of the drum 1, and the cleaning unit 3, feed unit 12, transfer unit 4, discharge unit 8 and discharge lamp 9 are de-energized during the imaging operation. As the leading edge of the charged portion of the drum 1 reaches the point q, the light source 20 and mirrors 21 and 22 are energized to perform a first scan operation, with the mirror 21 moving leftward by the distance S. The light source 20 is de-energized and the mirrors 21 and 22 are returned to their rightmost positions. During this time, the drum 1 is allowed to rotate by a distance corresponding to L/N to skip one image space. It will be understood that since S is equal to or less than L/N even if a margin length L-J is not provided, the mirrors 21 and 22 have sufficient time to return to their initial positions at the scan velocities V and V/2 respectively. If $K=1$, the lamp 20 and mirrors 21 and 22 will be energized after the drum 1 has rotated so as to skip one image space. If $K \geqq 2$, the light source 20 and mirrors 21 and 22 will remain de-energized until K image spaces have been skipped. The process of imaging and skipping one or more image spaces is repeated until the drum 1 has completed M rotations and the N images have been formed.

The developing unit 3, sheet feed unit 12 and transfer unit 4 are then energized. The cutter 123 cuts the copy paper PA into lengths S, and the developing and transfer process described above is performed continuously until the desired number of copies has been produced. The cleaning unit 11, discharge unit 8 and discharge lamp 9 are then energized to prepare the drum 1 for another copying operation, the developing unit 3, transfer unit 4 and sheet feed unit 12 being de-energized.

The drum 1 rotates a number of times after the imaging process is completed to produce the desired copies. The electrostatic images on the drum 1 are developed the same number of times with the resulting toner images being transferred to the copy paper PA. It is advantageous not to energize the cleaning unit 3 during this process since about 10–20% of the developer TO remains on the drum 1 after each transfer operation to constitute a residual image. The developing efficiency is increased if this residual developer TO is allowed to remain on the drum 1 until the copying operation is finished.

As shown in FIG. 3, the shtter unit 14 is preferably included in the imaging system. The shutter unit 14 comprises a shutter plate 14*b* which is pivotal about a pin 14*a* so as to be movable into or out of the image path from the mirror 24. A tension spring 14*e* connected to an end 14*d* of the plate 14*b* urges the plate 14*b* counterclockwise to block the light path. A solenoid 14*c* has a plunger 14*f* which is also connected to the end 14*d* of the plate 14*b*.

When the control unit CU energizes the light source 20, it also energizes the solenoid 14*c* so that the plunger 14*f* rotates the blade 14*b* clockwise to unblock the light path. The shutter unit 14 allows more precise timing of the imaging than simply energizing and de-energizing the light source 20, and eliminates partial imaging during the lighting and extinction times of the light source 20. This is especially important where the margins between adjacent images are small. The shutter unit 14 further allows the use of inexpensive light source lamps which have relatively high lighting and extinction times.

The present invention fills the gap mentioned hereinabove and provides extremely efficient copying for numbers of copies between 1 and P. Although a plurality of identical images are formed on the drum 1 as in applicant's prior method for producting numbers of copies equal to or greater than P, the number of images formed is not necessarily the maximum number which can be formed, or is not necessarily equal to N.

Tables 3, 4, 5 and 6 tabulate the various methods of producing between 1 and 10 copies for values of N equal to 2, 3, 4 and 5 respectively. The process numbers such as 101, 221 etc. serve to individually designate the methods. Process numbers preceeded by one asterisk(*) indicate that the process or method is more efficient than the conventional single copying method, or that the indicated number of copies can be produced in less revolutions or rotations of the drum 1. Process numbers preceeded by two asterisks (**) indicate that the process is the most efficient. The processes indicated by two asterisks constitute the entries of table 7 which is utilized by the control unit CU to control the copying process. As with applicant's prior method, table 7 may most advantageously provided in the form of an electronic read-only memory (ROM) which is not shown.

List in the tables are the required numbers of rotations of the drum 1 for imaging, printing (development and transfer) and the total. The efficiency of the process is determined by the total number of rotations and is maximum when the total number of rotations is minimum.

Table 3

N = 2

| process number | No. of copies | No. of images | No. of rotations imaging | printing | total |
|---|---|---|---|---|---|
| ** 101 | 1 | 1 | 0 | 1 | 1 |
| ** 102 | 2 | 1 | 0 | 2 | 2 |
| ** 103 | 3 | 1 | 0 | 3 | 3 |
| 104 | 3 | 2 | 1 | 2 | 3 |
| 105 | 4 | 1 | 0 | 4 | 4 |
| ** 106 | 4 | 2 | 1 | 2 | 3 |
| 107 | 5 | 1 | 0 | 5 | 5 |
| ** 108 | 5 | 2 | 1 | 3 | 4 |
| 109 | 6 | 1 | 0 | 6 | 6 |
| ** 110 | 6 | 2 | 1 | 3 | 4 |
| 111 | 7 | 1 | 0 | 7 | 7 |
| ** 112 | 7 | 2 | 1 | 4 | 5 |
| 113 | 8 | 1 | 0 | 8 | 8 |
| ** 114 | 8 | 2 | 1 | 4 | 5 |
| 115 | 9 | 1 | 0 | 9 | 9 |
| ** 116 | 9 | 2 | 1 | 5 | 6 |
| 117 | 10 | 1 | 0 | 10 | 10 |
| ** 118 | 10 | 2 | 1 | 5 | 6 |

Table 4

N = 3

| process number | No. of copies | No. of images | No. of rotations imaging | printing | total |
|---|---|---|---|---|---|
| ** 201 | 1 | 1 | 0 | 1 | 1 |
| 202 | 2 | 1 | 0 | 2 | 2 |
| ** 203 | 2 | 2 | 0 | 1 | 1 |
| 204 | 3 | 1 | 0 | 3 | 3 |
| ** 205 | 3 | 2 | 0 | 2 | 2 |
| * 206 | 3 | 3 | 1 | 1 | 2 |
| 207 | 4 | 1 | 0 | 4 | 4 |
| ** 208 | 4 | 2 | 0 | 2 | 2 |
| * 209 | 4 | 3 | 1 | 2 | 3 |
| 210 | 5 | 1 | 0 | 5 | 5 |
| ** 211 | 5 | 2 | 0 | 3 | 3 |
| * 212 | 5 | 3 | 1 | 2 | 3 |
| 213 | 6 | 1 | 0 | 6 | 6 |
| ** 214 | 6 | 2 | 0 | 3 | 3 |
| * 215 | 6 | 3 | 1 | 2 | 3 |
| 216 | 7 | 1 | 0 | 7 | 7 |
| ** 217 | 7 | 2 | 0 | 4 | 4 |
| * 218 | 7 | 3 | 1 | 3 | 4 |
| 219 | 8 | 1 | 0 | 8 | 8 |
| ** 220 | 8 | 2 | 0 | 4 | 4 |
| * 221 | 8 | 3 | 1 | 3 | 4 |
| 222 | 9 | 1 | 0 | 9 | 9 |
| * 223 | 9 | 2 | 0 | 5 | 5 |
| ** 224 | 9 | 3 | 1 | 3 | 4 |
| 225 | 10 | 1 | 0 | 10 | 10 |
| ** 226 | 10 | 2 | 0 | 5 | 5 |
| * 227 | 10 | 3 | 1 | 4 | 5 |

Table 5

N = 4

| process number | No. of copies | No. of images | No. of rotations imaging | printing | total |
|---|---|---|---|---|---|
| ** 301 | 1 | 1 | 0 | 1 | 1 |
| 302 | 2 | 1 | 0 | 2 | 2 |
| ** 303 | 2 | 2 | 0 | 1 | 1 |
| 304 | 3 | 1 | 0 | 3 | 3 |
| ** 305 | 3 | 2 | 0 | 2 | 2 |
| * 306 | 3 | 3 | 1 | 1 | 2 |
| 307 | 4 | 1 | 0 | 4 | 4 |
| ** 308 | 4 | 2 | 0 | 2 | 2 |
| * 309 | 4 | 3 | 1 | 2 | 3 |
| * 310 | 4 | 4 | 2 | 1 | 3 |
| 311 | 5 | 1 | 0 | 5 | 5 |
| ** 312 | 5 | 2 | 0 | 3 | 3 |
| * 313 | 5 | 3 | 1 | 2 | 3 |
| * 314 | 5 | 4 | 2 | 2 | 4 |
| 315 | 6 | 1 | 0 | 6 | 6 |
| ** 316 | 6 | 2 | 0 | 3 | 3 |
| * 317 | 6 | 3 | 1 | 2 | 3 |
| * 318 | 6 | 4 | 2 | 2 | 4 |
| 319 | 7 | 1 | 0 | 7 | 7 |
| ** 320 | 7 | 2 | 0 | 4 | 4 |

Table 5-continued

N = 4

| process number | No. of copies | No. of images | No. of rotations imaging | printing | total |
|---|---|---|---|---|---|
| * 321 | 7 | 3 | 1 | 3 | 4 |
| * 322 | 7 | 4 | 2 | 2 | 4 |
| 323 | 8 | 1 | 0 | 8 | 8 |
| ** 324 | 8 | 2 | 0 | 4 | 4 |
| * 325 | 8 | 3 | 1 | 3 | 4 |
| * 326 | 8 | 4 | 2 | 2 | 4 |
| 327 | 9 | 1 | 0 | 9 | 9 |
| * 328 | 9 | 2 | 0 | 5 | 5 |
| ** 329 | 9 | 3 | 1 | 3 | 4 |
| * 330 | 9 | 4 | 2 | 3 | 5 |
| 331 | 10 | 1 | 0 | 10 | 10 |
| ** 332 | 10 | 2 | 0 | 5 | 5 |
| * 333 | 10 | 3 | 1 | 4 | 5 |
| * 334 | 10 | 4 | 2 | 3 | 5 |

Table 6

N = 5

| process number | No. of copies | No. of images | No. of rotations imaging | printing | total |
|---|---|---|---|---|---|
| ** 401 | 1 | 1 | 0 | 1 | 1 |
| ** 402 | 2 | 2 | 0 | 1 | 1 |
| 403 | 3 | 1 | 0 | 3 | 3 |
| ** 404 | 3 | 3 | 0 | 1 | 1 |
| 405 | 4 | 1 | 0 | 4 | 4 |
| ** 406 | 4 | 2 | 0 | 1 | 1 |
| 407 | 5 | 1 | 0 | 5 | 5 |
| ** 408 | 5 | 5 | 1 | 1 | 2 |
| 409 | 6 | 1 | 0 | 6 | 6 |
| * 410 | 6 | 2 | 0 | 3 | 3 |
| ** 411 | 6 | 3 | 0 | 2 | 2 |
| 412 | 7 | 1 | 0 | 7 | 7 |
| * 413 | 7 | 2 | 0 | 4 | 4 |
| ** 414 | 7 | 3 | 0 | 3 | 3 |
| 415 | 8 | 1 | 0 | 8 | 8 |
| * 416 | 8 | 2 | 0 | 4 | 4 |
| * 417 | 8 | 3 | 0 | 4 | 4 |
| ** 418 | 8 | 4 | 1 | 2 | 3 |
| 419 | 9 | 1 | 0 | 9 | 9 |
| * 420 | 9 | 2 | 0 | 5 | 5 |
| ** 421 | 9 | 3 | 0 | 3 | 3 |
| * 422 | 9 | 4 | 1 | 3 | 4 |
| 423 | 10 | 1 | 0 | 10 | 10 |
| * 424 | 10 | 2 | 0 | 5 | 5 |
| * 425 | 10 | 3 | 0 | 4 | 4 |
| * 426 | 10 | 4 | 1 | 3 | 4 |
| ** 427 | 10 | 5 | 1 | 2 | 3 |

Table 7

| process number | N | No. of copies | K | No. of images | No. of rotations imaging | printing | total |
|---|---|---|---|---|---|---|---|
| 501 | 1 | 1 | 0 | 1 | 0 | 1 | 1 |
| 502 | 1 | 2 | 0 | 1 | 0 | 2 | 2 |
| 503 | 1 | 3 | 0 | 1 | 0 | 3 | 3 |
| 504 | 1 | 4 | 0 | 1 | 0 | 4 | 4 |
| 505 | 1 | 5 | 0 | 1 | 0 | 5 | 5 |
| 506 | 1 | 6 | 0 | 1 | 0 | 6 | 6 |
| 507 | 1 | 7 | 0 | 1 | 0 | 7 | 7 |
| 508 | 1 | 8 | 0 | 1 | 0 | 8 | 8 |
| 509 | 1 | 9 | 0 | 1 | 0 | 9 | 9 |
| 510 | 1 | 10 | 0 | 1 | 0 | 10 | 10 |
| 511 | 2 | 1 | 0 | 1 | 0 | 1 | 1 |
| 512 | 2 | 2 | 0 | 1 | 0 | 2 | 2 |
| 513 | 2 | 3 | 0 | 1 | 0 | 3 | 3 |
| 5134 | 2 | 4 | 2 | 2 | 1 | 2 | 3 |
| 515 | 2 | 5 | 2 | 2 | 1 | 3 | 4 |
| 516 | 2 | 6 | 2 | 2 | 1 | 3 | 4 |
| 517 | 2 | 7 | 2 | 2 | 1 | 4 | 5 |
| 518 | 2 | 8 | 2 | 2 | 1 | 4 | 5 |
| 519 | 2 | 9 | 2 | 2 | 1 | 5 | 6 |
| 520 | 2 | 10 | 2 | 2 | 1 | 5 | 6 |
| 521 | 3 | 1 | 0 | 1 | 0 | 1 | 1 |
| 522 | 3 | 2 | 1 | 2 | 0 | 1 | 1 |
| 523 | 3 | 3 | 1 | 2 | 0 | 2 | 2 |
| 524 | 3 | 4 | 1 | 2 | 0 | 2 | 2 |
| 525 | 3 | 5 | 1 | 2 | 0 | 3 | 3 |
| 526 | 3 | 6 | 1 | 2 | 0 | 3 | 3 |
| 527 | 3 | 7 | 1 | 2 | 0 | 4 | 4 |
| 528 | 3 | 8 | 1 | 2 | 0 | 4 | 4 |
| 529 | 3 | 9 | 1 | 3 | 1 | 3 | 4 |
| 530 | 3 | 10 | 1 | 2 | 0 | 5 | 5 |

Table 7-continued

| process number | N | No. of copies | K | No. of images | No. of rotations imaging | printing | total |
|---|---|---|---|---|---|---|---|
| 531 | 4 | 1 | 0 | 1 | 0 | 1 | 1 |
| 532 | 4 | 2 | 2 | 2 | 0 | 1 | 1 |
| 533 | 4 | 3 | 2 | 2 | 0 | 2 | 2 |
| 534 | 4 | 4 | 2 | 2 | 0 | 2 | 2 |
| 535 | 4 | 5 | 2 | 2 | 0 | 3 | 3 |
| 536 | 4 | 6 | 2 | 2 | 0 | 3 | 3 |
| 537 | 4 | 7 | 2 | 2 | 0 | 4 | 4 |
| 538 | 4 | 8 | 2 | 2 | 0 | 4 | 4 |
| 539 | 4 | 9 | 2 | 3 | 1 | 3 | 4 |
| 540 | 4 | 10 | 2 | 2 | 0 | 5 | 5 |
| 541 | 5 | 1 | 0 | 1 | 0 | 1 | 1 |
| 542 | 5 | 2 | 1 | 2 | 0 | 1 | 1 |
| 543 | 5 | 3 | 1 | 3 | 0 | 1 | 1 |
| 544 | 5 | 4 | 1 | 2 | 0 | 2 | 2 |
| 545 | 5 | 5 | 1 | 5 | 1 | 1 | 2 |
| 546 | 5 | 6 | 1 | 3 | 0 | 2 | 2 |
| 547 | 5 | 7 | 1 | 3 | 0 | 3 | 3 |
| 548 | 5 | 8 | 1 | 4 | 1 | 2 | 3 |
| 549 | 5 | 9 | 1 | 3 | 0 | 3 | 3 |
| 550 | 5 | 10 | 1 | 5 | 1 | 2 | 3 |

The present method resembles the conventional method and differs from applicant's prior method in that development and transfer is effected during the last imaging rotation of the drum 1. Where there is only one imaging rotation, development and transfer are performed during this rotation. However, subsequent to the last imaging rotation (and first printing rotation) one or more printing rotations may be performed. In the tables, the number of rotations for imaging indicates the number of rotations required for imaging only, during which no printing is effected. Thus, if all images are formed on the drum 1 during one rotation and printing is carried out during this same rotation, the number of rotations for imaging is indicated as zero.

The present invention will now be described for the case where it is desired to make 9 copies and N=4 (see table 5). This example illustrates the concept of the invention, and it is believed that all other entries in the tables may be understood by those skilled in the art after this concept is understood.

Process number 327 illustrates the conventional single copying method. Only one image is formed on the drum 1. The drum 1 is subjected to 9 rotations, during each of which a new electrostatic image is formed and printed. The numbers of rotations required for imaging only and printing are 0 and 9 respectively.

Process number 328 illustrates the case in which 2 electrostatic images are formed on the drum 1. It will be noted that since N=4, up to 4 electrostatic images may be formed on the drum 1. Since N=4, K=2. During the first rotation of the drum 1, the two images are formed and printed for the first time. More specifically, the first image is formed, two image spaces are skipped and then the second image is formed. Two copies are produced during the first rotation of the drum 1.

During the next 3 rotations of the drum 1 the two electrostatic images are developed and transferred without further imaging to produce 6 more, or a total of 8 copies. During the last rotation of the drum 1, the first image is developed and transferred to produce the 9th or last copy. The developing and transfer units 3 and 4 are then de-energized so that the second electrostatic image is not developed or transferred during the last rotation of the drum 1. As indicated, the total number of rotations of the drum 1 is 5.

Process number 329 illustrates the case where 3 electrostatic images are formed. In this case, two images are formed during the first rotation of the drum 1 while the developing and transfer units 3 and 4 respectively are de-energized. During the second rotation of the drum 1, the third image is formed and all three images are developed and transferred to produce the first three copies. The three images are developed and transferred during two more rotations of the drum 1 to produce the last six copies. The total number of rotations of the drum 1 is 4.

Finally, process number 330 illustrates the case where the maximum number, or 4 electrostatic images are formed on the drum 1. Three rotations of the drum 1 are required to form the four images since K=2, and development and transfer are performed during the last imaging rotation. Therefore, the number of rotations required for imaging only is 2. During the third rotation of the drum 1 the first 4 copies are produced. During the fourth rotation of the drum 1 four more copies are produced. During the last rotation of the drum 1 one electrostatic image is developed and transferred to produce the last copy. The developing and transfer units 3 and 4 are thereafter de-energized and the other three images are not developed or transferred. The total number of rotations of the drum 1 is 5.

It will be seen that where it is desired to produce 9 copies and N=4, four different processes are possible by forming 1, 2, 3 and 4 electrostatic images respectively on the drum 1. However, process number 329 is the most efficient since it requires only 4 revolutions of the drum 1. Compared to the conventional copying process requiring 9 rotations of the drum 1, process number 329 increases the copying speed by 125%. Therefore, whenever it is desired to make 9 copies and N=4, the control unit CU will control the apparatus to perform process number 329. Table 7 tabulates the most efficient processes for each value of the number of copies and the length of the original document (corresponding to N), and is utilized by the control unit CU to control the apparatus. It will be noted that process number 329 appears in table 7 as process number 539. In each case, the most efficient process is that which produces the required number of copies in the minimum number of total revolutions of the drum 1.

Comparing processes 211 and 212, it will be seen that both require 3 rotations of the drum 1. However, process 211 requires the formation of only 2 electrostatic images whereas process 212 requires the formation of 3 electrostatic images. Process 211 is therefore preferred from the viewpoint of conservation of electrical energy and maximization of the service life of the light source 20, since 50% more electrical energy is required to form 3 electrostatic images than to form 2 electrostatic images. Process 211 appears in table 7 as process 525.

It will be noted that process 329 utilizes only 3 electrostatic images although 4 electrostatic images may be formed. Therefore, there is a blank image space on the drum 1. To avoid development and transfer of this blank space which would produce black copies and impose a strain on the cleaning unit 11, the developing and transfer units 3 and 4 respectively are preferably de-energized when blank image spaces on the drum 1 pass thereby. This is accomplished by the control unit utilizing the data in table 7.

In summary, it will be seen that the present invention perfects the method disclosed in applicant's prior patent application by providing maximum copying efficiency regardless of the number of copies to be produced and the size of the original documents. Various modifications will become possible for those skilled in the art after receiving the teachings of the present disclosure without departing from the scope thereof.

What is claimed is:

1. An electrophotographic apparatus comprising:

a photoconductive member having a continuously rotatably moving endless surface;

imaging means operatively arranged relative to the photoconductive member for forming a plurality of identical, circumferentially spaced electrostatic images on the photoconductive member;

developing and transfer means for developing the electrostatic images to form toner images and transferring the toner images to copy sheets; and control means for controlling the imaging means and the developing and transfer means, the control means being operative to compute as a function of a number of copies to be made and a circumferential length of each of the electrostatic images, a number of the electrostatic images to be formed on the photoconductive member for producing the number of copies to be made in a minimum number of revolutions of the photoconductive member.

2. An apparatus as in claim 1, in which the control means controls the imaging means to form the electrostatic images on a plurality of equally circumferentially spaced identical image spaces on the photoconductive member, a maximum number of the electrostatic images to be formed being equal to a number of the image spaces.

3. An apparatus as in claim 2, in which the control means controls the imaging means to form the electrostatic images on the photoconductive member by alternately energizing the imaging means as one of the image spaces passes thereby and de-energizing the imaging means as at least one of the image spaces passes thereby.

4. An apparatus as in claim 3, in which the control means is operative to control the imaging means to form the electrostatic images on the photoconductive member during a plurality of revolutions of the photoconductive member, the control means energizing the developing and transfer means during a last revolution of said plurality of revolutions.

5. An apparatus as in claim 3, in which the imaging means comprises a scan member movable in a scan direction and a return direction, the scan member being moved in the scan direction when the imaging means is energized and in the return direction when the imaging means is de-energized.

6. An apparatus as in claim 5, in which the scan member moves in the scan and return directions as a same speed.

7. An apparatus as in claim 3, in which the imaging means comprises a shutter means controlled by the control means to open when the imaging means is energized and closed when the imaging means is de-energized.

8. An apparatus as in claim 3, in which the imaging means comprises:

a document holder;

a first mirror movable at a velocity V in the scan direction relative to the document holder to reflect a light image from the document holder;

a second mirror movable at a velocity V/2 in the scan direction to reflect the light image from the first mirror;

a fixed converging lens having a reflecting rear plane surface to reflect the light image from the second mirror; and a third mirror to reflect the light image from the converging lens onto the surface of the photoconductive member.

* * * * *